United States Patent [19]

Schaefer et al.

[11] 4,027,862

[45] June 7, 1977

[54] METAL MELTING FURNACE WITH ALTERNATE HEATING SYSTEMS

[75] Inventors: Carl W. D. Schaefer; Richard L. Schaefer, both of Dayton; Gordon F. Kennedy, Miamisburg, all of Ohio

[73] Assignee: Frank W. Schaefer Inc., Dayton, Ohio

[22] Filed: Dec. 19, 1975

[21] Appl. No.: 642,243

[52] U.S. Cl. ..... 266/160; 266/214

[51] Int. Cl.[2] ..... C21B 11/00

[58] Field of Search ..... 266/160, 214

[56] References Cited

UNITED STATES PATENTS 3,290,031 12/1966 Maatsch et al. ..... 266/214 X

*Primary Examiner*—John E. Roethel

*Attorney, Agent, or Firm*—Dybvig & Dybvig

[57] ABSTRACT

The upper structure of an aluminum melting furnace is constructed with supporting structure for a fossil fuel burner and supporting structure for electrically operated heating elements. The furnace may thus be operated with alternate heating systems, one system using fossil fuel and the other electricity.

1 Claim, 4 Drawing Figures

METAL MELTING FURNACE WITH ALTERNATE HEATING SYSTEMS

BACKGROUND OF THE INVENTION

The present invention relates to reverberatory heating furnaces for melting metals, and more particularly to aluminum melting furnaces in which heat may be generated by alternate energy sources.

It has long been known to use fossil fuels, such as natural gas, oil, propane, and methane, in operating reverberatory furnaces; more recently, it is known to use electrical resistance heating elements in such furnaces. While the use of either fossil fuels or electricity in metal melting furnaces is generally considered to be dependable, economical and efficient, the ready availability of fossil fuels and electricity to industrial users is no longer presumed as it was in the past. Rather, the fossil fuel or electricity consumer is often threatened with shortages, seasonal and otherwise, with fossil fuels scarce during some periods and electricity scarce in other periods. The operator of a metal melting furnace in the predicament of a shortage of his normal source of energy may have to curtail or even cease operation of the furnace. The alternative of having duplicate furnaces, one using fossil fuel and the other using electricity, is manifestly impractical.

SUMMARY OF THE INVENTION

In accordance with this invention, a furnace structure is provided having means for supporting two heating systems using alternate energy sources. The furnace structure has a reservoir or lower structure for containing molten metal and an upper structure. Means are provided in the roof of the upper structure for supporting a heating system adaptable to use a fossil fuel (natural gas, oil, propane, methane, etc.) for supplying heat to the heating chamber. When fossil fuel is to be used, at least one removable fossil fuel radiant burner is mounted by first support means in the roof and a flue opens through the roof. When the electrical heating system is to be used, the burner is removed and its roof opening and the flue are plugged.

The electrical heating system includes radiant resistance heating elements adapted to span and be supported by second support means on the sidewalls of the upper structure for electrically heating the heating chamber. The resistance heating elements extend through apertures in the sidewalls which are plugged when the fossil fuel heating system is to be used. Thus, when the furnace is to be operated by fossil fuel, the electric resistance heating elements are removed, and, when the furnace is to be operated by electricity, the fuel-operated burner is, or burners are, removed.

The present invention permits the furnace operator to convert from fossil fuel to electricity if fossil fuel becomes scarce or less practical, or to convert from electricity to fossil fuel if electricity becomes scarce or less practical. The time and cost involved is minimal so that conversions back and forth can be made as frequently as circumstances warrant.

DESCRIPTION OF THE PREFERRED EMBODIMENT

Figure 1:
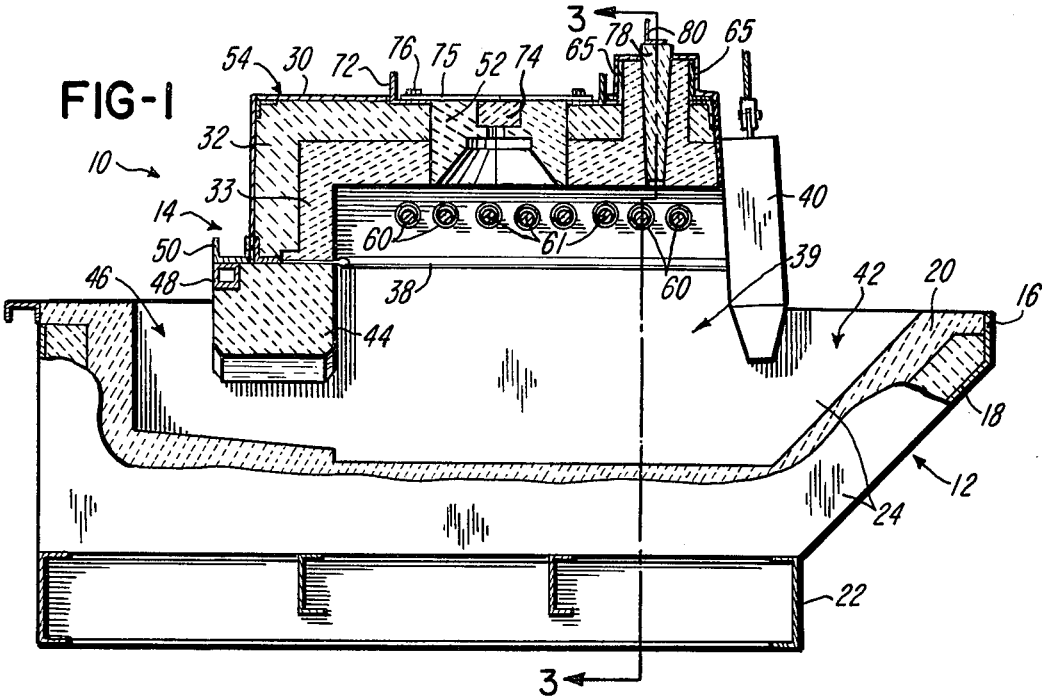
FIG. 1 is an elevational view, with parts broken away and in section, of a melting furnace in accordance with this invention, equipped to be heated by electricity.
Figure 3:
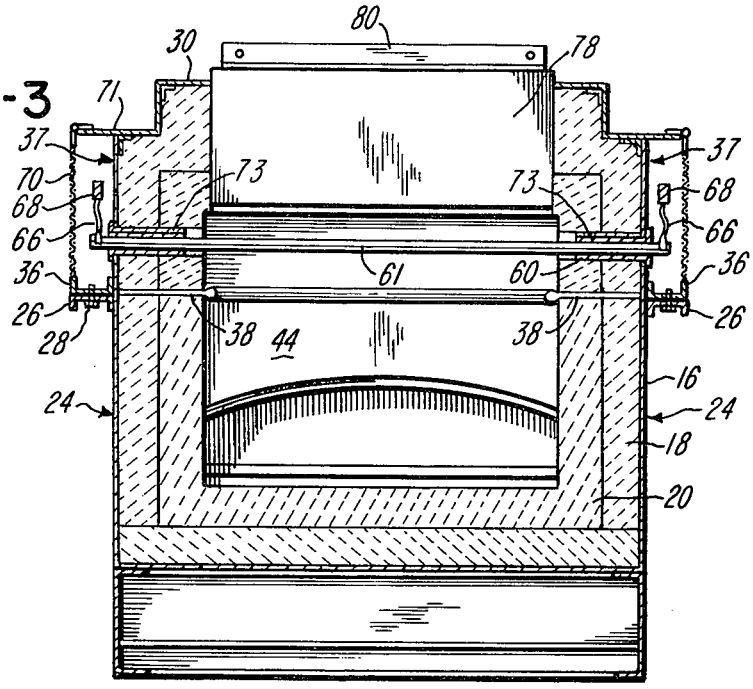
FIG. 3 is a section view taken substantially along the line 3—3 of FIG. 1.

Referring to FIG. 1, a melting furnace 10 in accordance with the present invention comprises a reservoir or lower furnace structure 12 for holding aluminum or other metal and an upper furnace structure 14 on top of the lower structure 12. The illustrated lower structure 12 is typical of various constructions that can be employed and includes a steel casing 16 lined with an insulating refractory 18 which in turn is lined with a non-wetting, high alumina hot face lining 20, all mounted on structural steel members 22. As best shown in FIG. 3, the lower structure 12 includes sidewalls, generally designated 24. Longitudinally extending, downwardly opening channel irons 26 are mounted on the casing 16 along the upper ends of the sidewalls 24. Plural, upwardly projecting guide pins 28 are mounted to the channel irons 26 and, as will be described below, cooperate with the sidewalls 24 and channel irons 26 in forming a support for the upper structure 14.

Referring to FIGS. 1 and 3, the upper structure 14 includes a steel casing 30 lined with a layer 32 of insulating material and a hot face lining 33 of refractory. Upwardly opening channel irons 36 overlying the aforementioned channel irons 26 are mounted longitudinally along the bottom of two opposing sidewalls 37 of the upper structure 14. The channel irons 36 are apertured at spaced intervals to receive the guide pins 28 which, when the upper structure 14 is placed on the lower structure 12, act to properly position the upper structure 14 above the lower structure 12. During the life of the furnace, the refractory in the lower structure 12 tends to expand vertically and the guide pins 28 function to maintain the upper structure 14 centered on the lower structure 12. A ceramic cushion 38 separates the upper structure 14 from the lower structure 12.

The center interior portion of the lower structure 12 and the overlying upper structure 14 form a heating chamber 39. A submergible, vertically sliding door 40 is mounted by supporting structure (not shown) on the lower structure 12 near one end of upper structure 14. The door 40, when submerged in molten metal 41 contained in the lower structure 12 (FIG. 2), closes the heating chamber 39 on one side and separates it from a charging well 42. Mounted on the lower structure 12 near the opposite end of the upper structure 14 is an arch 44 submerged in the molten metal 41 to close that side of the heating chamber 39 and separate it from a hot metal well 46. A hollow rectangular structural member 48 extends across the arch 44 and supports a channel iron 50 which is mounted across the top of the arch 44 and resists a tendency of the upper structure 14 to bow outwardly.

Figure 2:
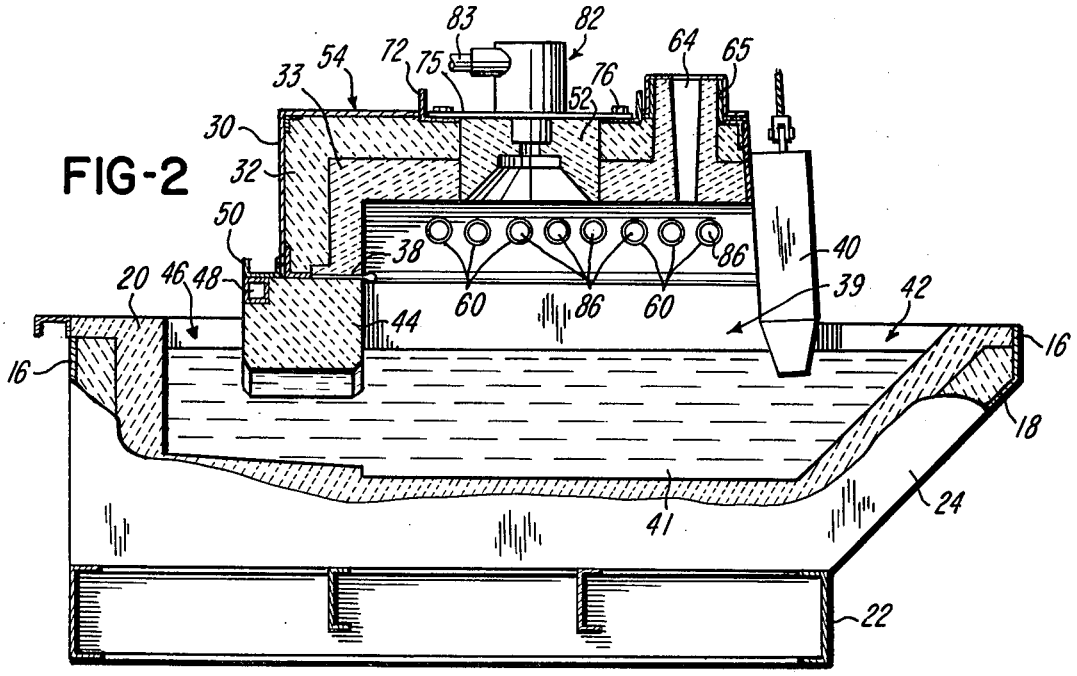
FIG. 2 is a view similar to FIG. 1 with the furnace equipped to use a fossil fuel.

In use, the door 40 normally occupies the position shown in FIGS. 1 and 2 wherein its lower end is beneath the top surface of the molten metal 41. The submerged arch 44 is likewise beneath the top surface of the molten metal so that neither the charging of unmelted metal into the charging well 42, the melting of the metal therein, nor the removal of melt from the hot metal well 46, will substantially disrupt or cause splashing at the surface of the molten metal in the heating chamber.

The structure as thus far described may be entirely conventional and it is to be understood that the illustrated furnace represents only one furnace construction with which this invention is usable, others being readily apparent to those familiar with the art. For example, either the charging well or the hot metal may extend from a side rather than an end of the heating chamber. Other constructional details may be varied as desired. It should be noted, however, that it is important to separate the charging well 42 from the heating chamber 39 by a submerged door or the like to avoid splashing of the molten metal within the heating chamber, since splashing would adversely affect the electrical resistance heating elements or the fossil fuel burner to be described below. Also it should be noted that the basic furnace construction thus far described has been used in prior reverberatory furnaces, this type of construction being previously used for furnaces having gas or other fossil fuel-fired radiant burners. More recently this type of furnace construction has been used for melting furnaces heated by electrical resistance heating elements.

In accordance with this invention, the heating system structure contained within the furnace includes a burner tile 52 extending through the roof, generally designated 54, of the upper structure 14, a series of mutually spaced sidewall apertures 60 in each of the sidewalls 37, each of the sidewall apertures 60 on one of the sidewalls being paired and axially aligned with one of the sidewall apertures 60 on the other of the sidewalls, and a transverse flue 64 extending through the roof 54 to vent exhaust gases when the heating system of the furnace is operating with a fossil fuel burner. Burner tile 52 depends from a support plate 75 overlapping a pair of structural steel brace members 72 extending transversely of the roof 54 and secured thereto by bolts 76. In the drawings the burner tile 52 is square in plan view and is so illustrated because many commercially available burners are so constructed. For purposes of this invention the burner tile aperture in the roof 54 would take the shape of the burner tile which is intended to be used. The flue 64 comprises an elongate slot having tapering, downwardly converging longer sidewalls. The upper end of the flue projects above the surrounding roof structure and the upper portion thereof is braced by an angle iron 65 on each side thereof.

As is shown in FIGS. 1 and 3, the furnace is adapted to use an electrical heating system by inserting an electrically operated radiant heating element 61 through each corresponding pair of sidewall apertures 60. The heating elements 61, which preferably comprise silicon carbide resistance bars, are connected at the exterior of the sidewalls 37 by electrical connectors 66 to bus bars 68 which in turn are connected to an electrical energy source (not shown). Shields 70 are hinged to overhanging portions 71 of the steel casing 30, protecting the ends of the heating elements 61 and the electrical connections thereto.

When using the electrical heating system, the burner nozzle opening in the burner tile 52 is closed by a removable plug 74 made of refractory material. Ceramic fiber or a castable refractory would be satisfactory for this purpose. The peripheral dimensions of the burner plug 74 would be substantially identical to the burner nozzle aperture at the top of the burner tile 52. The flue 64 is closed by a removable flue plug 78, also made of a suitable refractory material, which has a steel lift arm 80. The flue plug 78 has tapering sides corresponding to the tapering sidewalls of the flue 64 and preferably has a maximum thickness greater than the maximum width of the flue 64 so that it projects partly above the flue. The plug 78 is coextensive in length with the flue 64.

Accordingly, when the furnace is to be electrically operated, the entire roof structure is sealed to prevent the entrance or escape of gases. Heating of the molten metal within the heating chamber is accomplished purely radiantly upon energization of the electric resistance elements 61. As best shown in FIG. 3, the apertures 60 through which the heating elements 61 extend are preferably closed by ceramic, insulating tubes or packing material 73. Accordingly, the external electrical components, such as 66 and 68, are insulated from the heating chamber. There is a minimum loss of heat from the heating chamber through the furnace structure and essentially no movement of air or gases within the heating chamber above the melt.

The use of electric resistance heating elements and the advantages of the structural details of a furnace equipped with electric resistance heating elements are discussed in copending application Ser. No. 541,883, filed Jan. 17, 1975, and assigned to the same assignee as the instant application.

Figure 4:
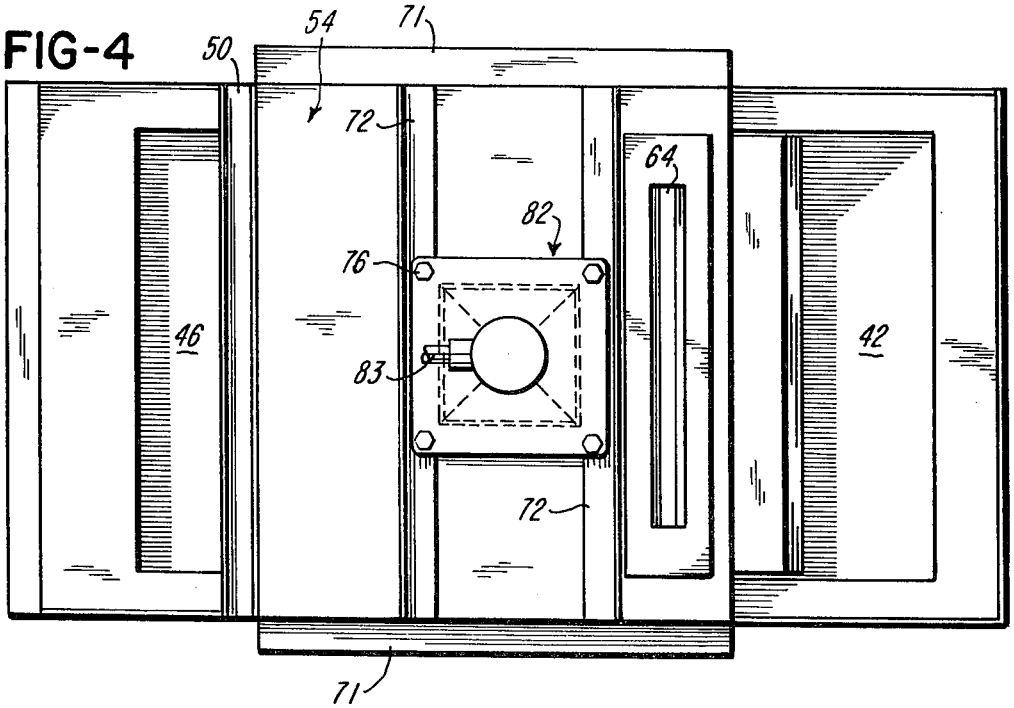
FIG. 4 is a top plan view of the furnace construction equipped as shown in FIG. 2.

As shown in FIGS. 2 and 4, when it is desired to convert the furnace to use fossil fuel, the plugs 74 and 78 are removed and a fossil fuel-fired element or burner nozzle 82 is inserted into the aperture extending through the burner tile 52. The heating elements 61 are disconnected from the connectors 66 and removed from the sidewall apertures 60. The apertures 60 are then closed by sidewall aperture plugs 86, which may comprise a ceramic packing material. The illustrated burner nozzle 82 is of a conventional type which would operate with a fluid fuel such as natural gas or fuel oil. The burner has one or more connector pipes 83 for connecting the burner nozzle 82 to a fossil fuel energy source (not shown) and a combustion air pipe (not shown).

The operation of the furnace equipped with the fossil fuel radiant heating system is entirely conventional and the same as the operation of furnaces that have been used for many years, the products of the combustion of the burner 82 flowing along the underside of the roof structure and out through the flue 64. Since the apertures 60 are closed by plugs 86, any electrical components on the outside of the roof structure remain insulated from the heating chamber, and these electrical components can remain in place ready to be used in the event the furnace is thereafter converted to use the electrical resistance elements 61.

Those familiar with furnace constructions will appreciate that the two heating systems will require separate controls. These controls may be entirely conventional and are thus not illustrated herein. Further, a conventional sensing system will be required to monitor the temperature within the heating chamber. It is optional whether separate sensing systems for the two heating systems are used or whether a single sensing system is used. In any event, one utilizing this invention may so design the two heating systems that the capacity of the furnace is essentially the same regardless of the heating system in use.

At the present time, many fossil fuel-fired melting furnaces would cost approximately two-thirds as much as an electric melting furnace if the same capacity. The furnace of this invention, with the necessary connections, sensors and controls, may cost rougly 20% more than an electric melting furnace of the same capacity and general design. Therefore, there is a substantial potential savings for any furnace user who would be faced with the necessity of occasionally changing from one heating system to the other. In comparison with the alternative of installing two completely different furnaces, there is an additional savings in space. Furthermore, the various plugs are easily removed and replaced with heating system components so that it is possible to convert from one energy source to the outer without substantial down time. It should be possible to make the conversion in a sufficiently short time that the molten metal will not solidify.

It may also be recognized that the invention herein could be used for holding furnaces which do not have the high heat requirement of melting furnaces. However, because of the relatively low heat requirements, a conversion from one type of energy to another for holding purposes would ordinarily not be necessary.

Although the presently preferred embodiment of this invention has been described, it will be understood that within the purview of this invention various changes may be made within the scope of the appended claims.

Having thus described our invention, we claim:

1. In a furnace structure for a reverberatory metal melting furnace of the type having a lower furnace structure for holding metal and an upper furnace structure supported on top of the lower furnace structure and having means including sidewalls and a roof supported by said sidewalls cooperating with the lower furnace structure and molten metal therein defining a heating chamber, the improvement permitting conversion between the use of a fossil fuel fired radiant heating element and an electrically operated radiant heating element including means defining an aperture extending through said roof and a roof portion around said aperture for supporting said fossil fuel fired element in said aperture, means defining a flue for exhausting gases from said heating chamber when using said fossil fuel fired element, means defining mutually aligned apertures adapted for receiving the ends of said electrical resistance heating elements in said sidewalls, and means for plugging said apertures and said flue so that said fossil fuel fired heating element may be used for melting metal in said lower furnace structure or said electrical resistance heating element may be used for melting metal in said lower furnace structure and the conversion from one of said elements to the other of said elements may conveniently be made by installing the desired heating element in said aperture or apertures provided therefor and plugging and unplugging said aperture or apertures and said flue as needed.

* * * * *

UNITED STATES PATENT OFFICE

CERTIFICATE OF CORRECTION

PATENT NO. : 4,027,862

DATED : June 7, 1977

INVENTOR(S) : Carl W. D. Schaefer et al

It is certified that error appears in the above-identified patent and that said Letters Patent are hereby corrected as shown below:

Col. 3, line 8, after "metal" insert ---well---.
Col. 5, line 3, "if" should be ---of---.
Col. 5, line 5, "rougly" should be ---roughly---.
Col. 5, line 15, "outer" should be ---other---.

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*